US006014540A

United States Patent [19]

Sako et al.

[11] Patent Number: 6,014,540

[45] Date of Patent: Jan. 11, 2000

[54] IMAGE FORMING APPARATUS HAVING A DEVICE FOR REMOVING CHARGED MATERIALS PRIOR TO CLEANING

[75] Inventors: Mineyuki Sako, Toyokawa; Kenzo Toya, Okazaki; Kazuhiro Sakamoto; Hiroshi Fukao, both of Toyokawa, all of Japan

[73] Assignee: Minolta Co., Ltd., Osaka, Japan

[21] Appl. No.: 09/111,889

[22] Filed: Jul. 8, 1998

[30] Foreign Application Priority Data

Jul. 9, 1997 [JP] Japan ..... 9-183546
Sep. 11, 1997 [JP] Japan ..... 9-246990

[51] Int. Cl.[7] ..... G03G 21/00

[52] U.S. Cl. ..... 399/343; 399/349

[58] Field of Search ..... 399/343, 349, 399/353, 354

[56] References Cited

U.S. PATENT DOCUMENTS 4,741,942 5/1988 Swift ..... 399/353 X
5,220,390 6/1993 Ohtani et al. .

*Primary Examiner*—Susan S. Y. Lee
*Attorney, Agent, or Firm*—McDermott, Will & Emery

[57] ABSTRACT

An image forming apparatus includes a movable recording medium bearing member, an image forming device for forming an image on the image bearing member with a developer having an additive and a cleaning device having a cleaning member which makes a contact with the image bearing member for cleaning thereof at a cleaning station. The apparatus further includes a transferring device for transferring the image from the image bearing member to a recording medium. A processing device is mounted between the transfer station and the cleaning station for processing the additive that has not been transferred but still remains on the image bearing member such that one component of the additive remains on the image bearing member and another component of the additive is removed.

9 Claims, 4 Drawing Sheets

IMAGE FORMING APPARATUS HAVING A DEVICE FOR REMOVING CHARGED MATERIALS PRIOR TO CLEANING

BACKGROUND OF THE INVENTION

The present invention relates to an image forming apparatus such as copy machine, printer and facsimile. In particular, the present invention relates to an image forming apparatus in which an image is formed on an image bearing member and then transferred to a recording medium or sheet.

Conventionally, there has been known an electrophotographic image forming device which, for providing an resultant image with a higher quality, uses a developer mixed with a great amount of additive of inorganic material. In particular, the additive is preferably used in a full color copy machine and printer. Indeed, the existence of the additive provides the developer with a uniform mixing thereof, a ready adherence thereof to the electrostatic latent image on the photosensitive member, a ready transference thereof from the photosensitive member to an image bearing member and an improved collectivity thereof from the photosensitive drum by a scraping blade.

It is preferable that the additive is added as much as possible in order to improve the mixing, developing and transferring properties of the developer. On the other hand, the amount of the additive to be added to the developer should be controlled. That is, an excessive adding of the additive increases the amount thereof that unavoidably moves past a contact region between the blade and the photosensitive member. This causes a part of the additive to be forced and applied onto the photosensitive member, which in turn results in noises in the resultant image and then degrading the same. An insufficient adding of the additive fails to form a stationary remaining thereof adjacent to the contact region of the blade and the photosensitive member, which decreases a collecting efficiency of developer from the photosensitive member. This results in defects in the resultant image, especially in the solid image.

To overcome these problems, U.S. Pat. No. 5,220,390 discloses an image forming device which includes a transfer station where a toner image is transferred from the photosensitive member to the sheet substrate, a cleaning station where the toner that has not been transferred to the sheet substrate is collected by the blade and a cleaning agent supply station where a cleaning agent (e.g., strontium titanate) is provided to the photosensitive member for improving the collectivity of the additive by the blade.

The disclosed image forming device requires a certain space around the photosensitive member that is exclusively occupied by the cleaning agent supply station. Disadvantageously, this increases a size of the photosensitive member. Particularly, for the full color image forming device which includes several photosensitive members for respective color toners, the size of the image forming device will be increased considerably if the cleaning agent supply station is added to each photosensitive member.

In addition, from tests made by the inventors of the present invention, it has been found that the additive includes not only particles effective for cleaning the toner but also particles ineffective therefor, and the effective particles are those charged to the same polarity as the toner while ineffective particles are those charged to opposite polarity.

SUMMARY OF THE INVENTION

Accordingly, in an aspect of an image forming apparatus according to the present invention, the image forming apparatus includes a movable recording medium bearing member having an outer surface. An image forming element, mounted adjacent to the outer surface of the recording medium bearing member, has an image bearing member for forming an image of developer and a cleaning device which makes a contact with the image bearing member for cleaning thereof. The apparatus further includes a recording medium supply device for supplying a recording medium onto the outer surface of the recording medium bearing member, a transferring device for transferring the image of the developer from the image bearing member of the image forming element to the recording medium born on the recording medium bearing member of the image forming element, and a cleaning agent supplying device for supplying a cleaning agent for the recording medium bearing member. A controller controls the recording medium bearing member and the transferring device to transfer the cleaning agent from the recording medium bearing member to the image bearing member and also for controlling the cleaning device to clean the image bearing member with an aid of the cleaning agent.

With this arrangement, the cleaning agent is supplied from the cleaning agent supply device to the recording medium bearing member and then to transferred to the image bearing member. Subsequently, the cleaning agent born on the image bearing member is transported to a contact region where the cleaning device contacts with the image bearing member and, at the contact region, is used for cleaning of the image bearing member.

In view of this, the cleaning agent supply device is arranged around the recording medium bearing member, so that the image bearing member is not required to be an enlarged size. This allows the image forming apparatus to be minimized.

In another aspect of the image forming apparatus according to the present invention, the image forming apparatus includes a movable image bearing member and an image forming device for forming an image on the image bearing member with an electrically charged developer with an additive. The additive includes one component capable of being charged to the same polarity as the developer and the other component capable of being charged to the different polarity from the developer. A transferring device is used for transferring the image from the image bearing member to an image bearing member at a transfer station. A cleaning device has a cleaning member which makes a contact with the image bearing member for cleaning the image bearing member at a cleaning station located on a downstream side of the transfer station with respect to a direction along which the image bearing member travels. Also, a processing device is mounted between the transfer station and the cleaning station for processing the additive that has not been transferred but remains on the image bearing member. Thus, the one component charged to the same polarity as the developer on the image bearing member is retained thereon and the other component charged to the different polarity from the developer is removed therefrom. The other component is then transported to a contact region of between the cleaning member and the image bearing member where it is used for improving the cleaning of the image bearing member. As a result, a residual developer remaining on the image bearing member is effectively removed therefrom. In addition, an excessive cleaning agent is transported through the contact region, resulting in higher quality images free from noises.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS (1) First Embodiment

Figure 1:
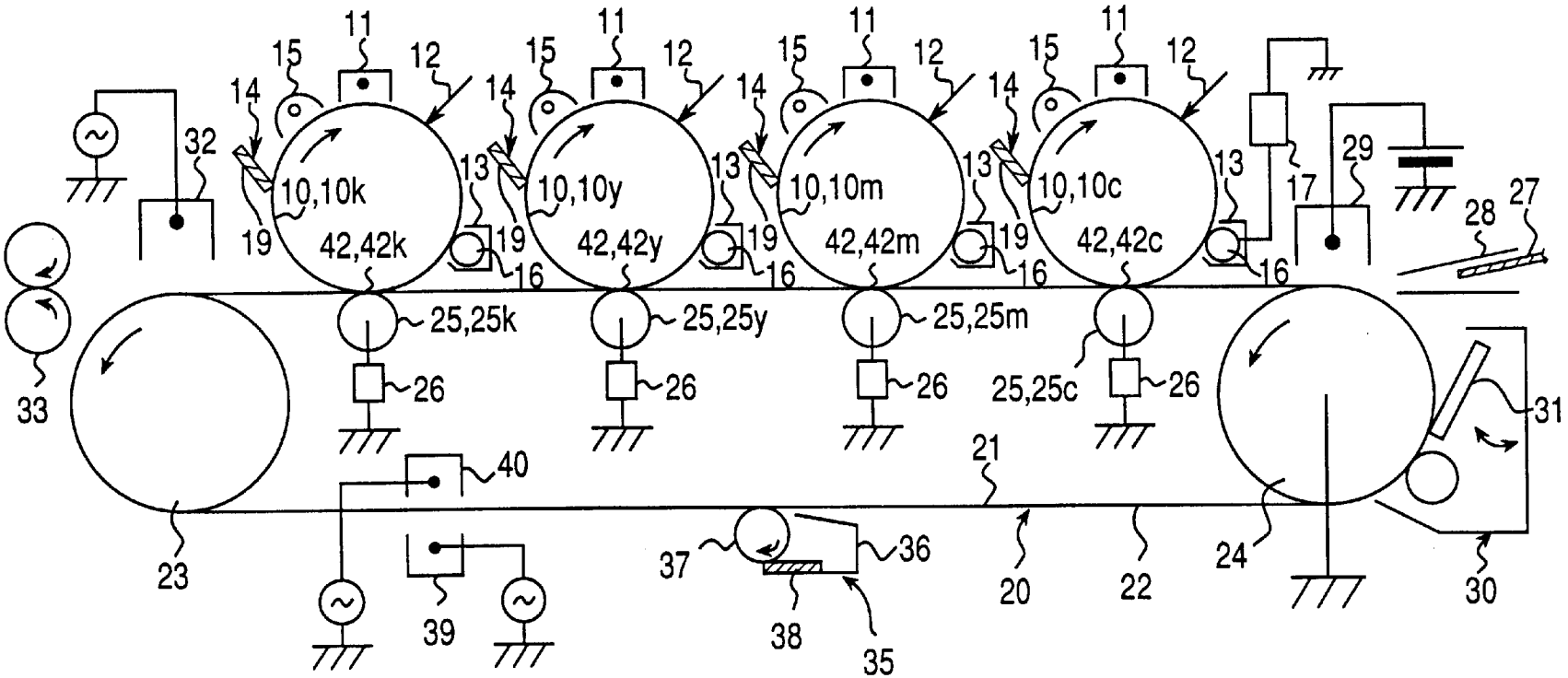
FIG. 1 is a cross sectional view of a main portion of an image forming apparatus according to the present invention.

With reference to the drawings, a first embodiment of the present invention will be described hereinafter. FIG. 1 shows a main portion of a full color image forming device, such as full color copy machine and printer, which includes four cylindrical photosensitive drum (i.e., image bearing member) 10 (10*c*, 10*m*, 10*y*, 10*k*). In this embodiment, the photosensitive drums 10 having the same size and configuration are positioned parallel to each other in intervals in a horizontal plane. Also, the photosensitive drums 10 are drivingly connected with a motor not shown so that they can be rotated individually in a clockwise direction in the drawing.

Around each photosensitive drum 10, a charging device 11, a exposing device 12, a developing device 13, a cleaning device 14 and an erasing device 15 are positioned in this order along the rotational direction of the photosensitive drum 10.

The charging device 11 is used to provide an outer surface of the photosensitive drum 10 with an electric charge of certain polarity. Any one of conventional charging devices such as non-contact type scrotoron and corotoron chargers and contact type brush roller and scraping blade can be employed for the charging device.

Preferably, the exposing device 12 employs a laser system capable of emitting the laser beam in response to a digital image information so that the laser beam is projected onto the charged region of the photosensitive drum 10 to form an electrostatic latent image that corresponds to the image information.

The developing device 13 is used for developing the electrostatic latent image using, so called, one-component or two-component developer. For reproducing a full color image, the developing devices 13 associated with the photosensitive drums 10*c*, 10*m*, 10*y*, 10*k* include cyan, magenta, yellow and black toners as developers, respectively. Each developing device 13 includes a developing roller 16. The developing roller 16 is electrically connected with a power supply 17 so that it can be applied with a certain developing bias. With a voltage difference between the developing bias and the surface voltage of the photosensitive drum 10, the charged toner is supplied from the developing roller 16 to the photosensitive drum 10, forming a toner image or visualized image. For clarity, only one power supply 17 for the right-end developing device is illustrated in the drawing and others are omitted therefrom.

The cleaning device 14 has a blade 19 which is arranged in parallel to the photosensitive drum 10. The blade 19 is fixed at one longitudinal end thereof and is forced at the other longitudinal end thereof to contact with the outer surface of the photosensitive drum 10 for scraping off a residual toner therefrom.

The erasing device 15 includes a lamp for projecting light onto the outer surface of the photosensitive drum 10, erasing a residual charge therefrom for the preparation of the next charging.

A transferring device 20 is mounted below the photosensitive drums 10 (10*c*, 10*m*, 10*y*, 10*k*). The transferring device 20, which cooperates with other devices including charging device 11 and developing device 13 to constitute an image forming element, includes a cylindrical endless belt 21 or cylindrical member. The endless belt 21 having an endless outer surface 22 is entrained around a pair of rollers, i.e., drive roller 23 and driven roller 24 both arranged within the endless belt 21 so that it can rotate in the direction indicated by the arrow (counter-clockwise direction in the drawing) by the rotation of the drive roller 23. Four transfer rollers 25 are arranged within the belt 21 so that they make contact with respective inner surface portions of the belt 21 and then bring corresponding outer surface portions thereof into contact with the photosensitive drums 10 (10*c*, 10*m*, 10*y*, 10*k*). The transfer rollers 25 are connected with respective transfer bias power supplies 26 so that they can be applied with respective voltages.

Adjacent to the driven roller 24, a sheet guide 28 is provided to supply a sheet substrate 27 onto an upper belt portion running from the driven roller 24 to the drive roller 23. A charger 29 is arranged above the driven roller 24 for providing an electric charge of certain polarity to the sheet substrate 27 travelling onto the upper belt portion. In addition, a belt cleaner 30 is arranged adjacent to the belt portion supported on the driven roller 24. The belt cleaner 30 includes a blade 31 capable of moving between a first position in which one longitudinal edge thereof spaces away from the belt 21 and a second position in which the longitudinal edge makes in contact with the belt 21.

Adjacent to the drive roller 23, on the other hand, an erasing device 32 is mounted to erase an electrical attraction force of between the belt 21 and the sheet substrate 27 supported on the belt 21, allowing the sheet substrate 27 to space away from the belt 21. Also, a pair of rollers 33 are mounted so that they can nip the sheet substrate 27 that has been separated from the belt 21 and then transport the substrate 27 into the next station.

A cleaning agent supplying device 35 underlies the lower belt portion which runs from the drive roller 23 to the driven roller 24. The device 35 includes a housing or container 36 for receiving a cleaning agent (e.g., strontium titanate), an apply roller 37 for applying the cleaning agent onto the outer surface of the belt 21, and a applying plate 38 which makes in contact with the outer surface of the apply roller 37 to form a contact region therewith. This allows the cleaning agent in the vicinity of the apply roller 37 to be transported due to the rotation of the apply roller 37 into the contact region where it is applied on the apply roller 37 and, at the same time, charged to a certain polarity. Chargers 39 and 40 are positioned between the drive roller 23 and the cleaning agent supplying device 35 so that they face outer and inner surfaces of the belt 21, respectively.

In the image forming operation of the image forming device so constructed, the photosensitive drums 10 (10*c*, 10*m*, 10*y*, 10*k*) are rotated in the clockwise direction and then charged at outer surfaces thereof to a certain voltage of, for example, −600 volts. The charged outer surfaces of the photosensitive drums 10 (10*c*, 10*m*, 10*y*, 10*k*) are exposed to lights corresponding to yellow, magenta, cyan and black image components, respectively, projected from exposing devices 12, which forms electrostatic latent images corresponding to the image components on respective photosensitive drums 10. Each of the latent images includes one portion where the electric charge is substantially discharged by the light exposure and the other portion where the electric charge is retained. The discharged electrostatic latent image portions on the photosensitive drums 10 (10*c*, 10*m*, 10*y*, 10*k*) are supplied with cyan, magenta, yellow and black toners, respectively, and thereby visualized into visible toner images.

Each visualization or developing of the electrostatic latent image is performed by the fact that the negatively charged toner is electrically attracted on the discharged portion with an aid of a voltage difference of between the surface of the photosensitive drum 10 (10*c*, 10*m*, 10*y*, 10*k*) and the developing bias (e.g., −300 volts) applied to the developing roller 16.

The sheet substrate 27 onto which the visualized toner image will be deposited is guided by the sheet guide 28 onto the upper belt portion. Immediately before the leading edge of the sheet substrate 27 has reached the upper belt portion, the charger 29 on the belt is energized. This causes the sheet substrate to be charged with an electric charge of negative polarity. The sheet substrate 27 is carried by the rotation of the belt 21 through contact regions 42 (42*c*, 42*m*, 42*y*, 42*k*), of the photosensitive drums 10 (10*c*, 10*m*, 10*y*, 10*k*) and the belt 21.

While the sheet substrate 27 is moved past the contact regions 42 (42*c*, 42*m*, 42*y*, 42*k*), the transfer rollers 25 (25*c*, 25*m*, 25*y*, 25*k*) is applied with respective voltages of positive polarity, for example, +4 KV, 5 KV, +6 KV, +7 KV. This allows the images visualized by the negatively charged toners, i.e., cyan, magenta, yellow, black toners, on the photosensitive drums 10 (10*c*, 10*m*, 10*y*, 10*k*) to be electrically attracted and then transferred onto the sheet substrate 27 one by one.

The sheet substrate 27 onto which all the toner images have been transferred is electrically erased by the discharge of the erasing device 32 adjacent to the drive roller 23. This eliminates the electrical attraction force of between the belt 21 and the sheet substrate 27, allowing the sheet substrate 27 to be spaced away from the belt 21 due to a rigidity of the sheet substrate 27. Subsequently, the sheet substrate 27 is transported to the next image processing station not shown. The portion of the belt separated from the sheet substrate 27, on the other hand, is electrically erased by the chargers 39 and 40 and then deprived of tiny foreign matters, e.g., paper particles, at the contact region of the belt 21 and the cleaning blade 31.

Figure 2:
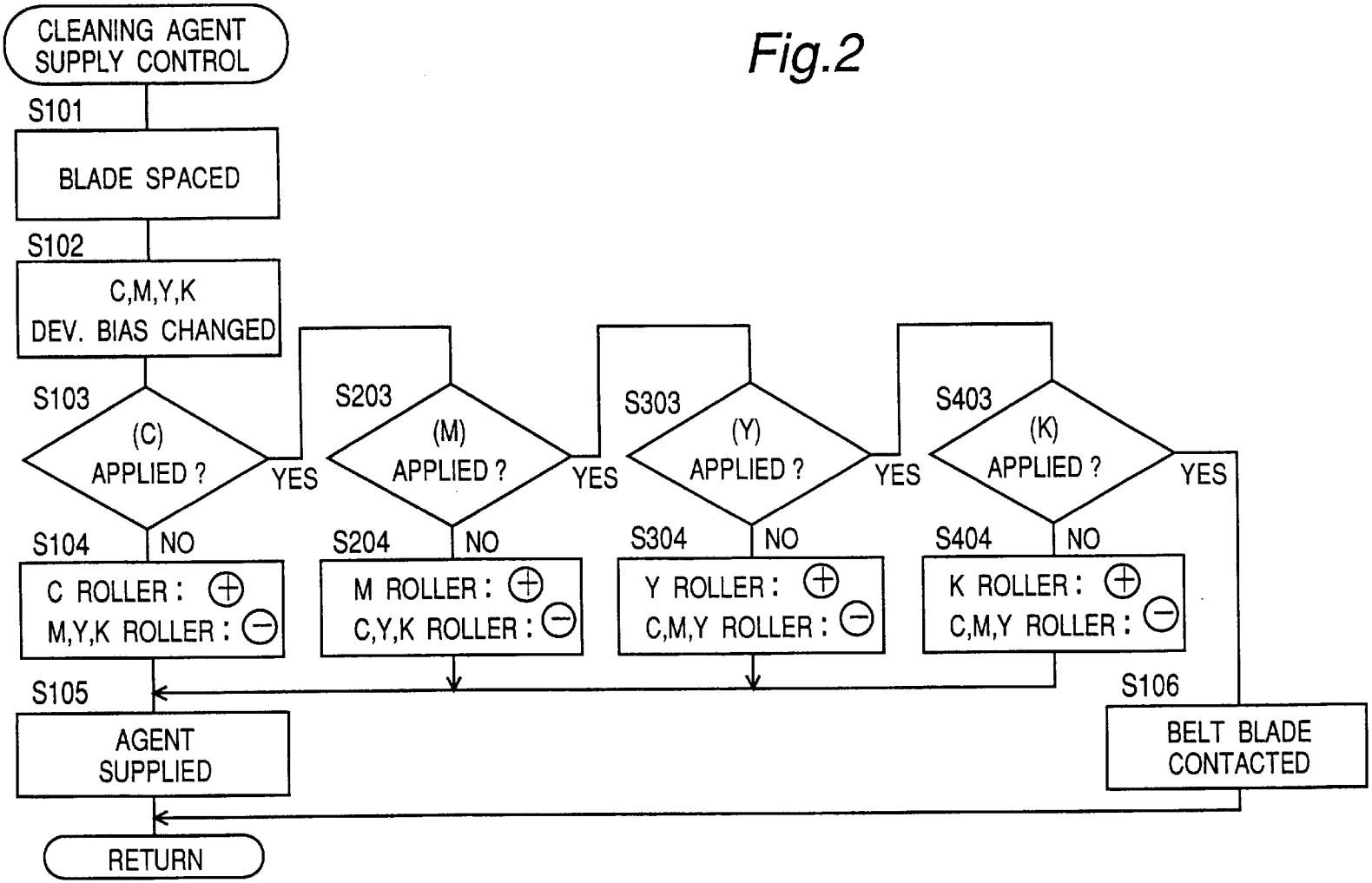
FIG. 2 is a program flow of a cleaning agent supply control performed in the image forming apparatus.

During the period in which the above-mentioned image forming process shown in FIG. 2 is not performed, i.e., before and/or after the image forming process, a process for supplying the cleaning agent onto the belt will be carried out. In this cleaning agent supplying process, the outer surfaces of the photosensitive drums 10 (10*c*, 10*m*, 10*y*, 10*k*) are charged with a certain voltage (−600 volts) by the associated chargers. The developing rollers 16 on the other hand are applied with the same voltage (−600 volts) as the photosensitive drums 10 (see step S102 in FIG. 2). This prevents the toners of the developers 13 from being transferred to the photosensitive drums 10 (10*c*, 10*m*, 10*y*, 10*k*), respectively.

The belt 21 of the transferring device 20 is rotated by the drive roller 23. The transfer roller 25 is applied with a certain voltage of negative polarity, charging the outer surface of the belt 21 with negative charge. The apply roller 37 of the cleaning agent applying device 35 is rotated, bringing the cleaning agent in the vicinity thereof into the contact region of between the apply roller 37 and the applying plate 38. In the contact region, the cleaning agent is applied to the apply roller 37 with an aid of the applying plate 37 and, at the same time, charged to the positive polarity. Therefore, the positively charged cleaning agent is attracted to the negatively charged belt.

The cleaning agent so applied to the outer surface of the belt 21 is transported by the rotation of the belt 21 into the contact regions 42 (42*c*, 42*m*, 42*y*, 42*k*), of the belt 21 and the photosensitive drums 10 (10*c*, 10*m*, 10*y*, 10*k*). At this moment, because the blade 31 of the cleaning device 30 is spaced away from the belt 21 (see step S101 in FIG. 2), no cleaning agent on the belt 21 is scraped out from the belt 21 by the blade 31.

Once the cleaning agent is transported to an opposing region of between the photosensitive drum 10*c* and the belt 21, the transfer roller 25*c* adjacent to the photosensitive drum 10*c* is applied with a certain voltage of positive polarity. This allows the cleaning agent held on the belt 21 to be transferred onto the photosensitive drum 10*c* (see steps S103, S104, S105 in FIG. 2). At this moment, other transfer rollers 25*m*, 25*y*, 25*k* are biased with voltages of negative polarity, which prevents the cleaning agent from being transferred onto the associated photosensitive drums 10*m*, 10*y*, 10*k*.

After a predetermined time period, the transfer roller 25*c* is applied with a voltage of negative polarity, which prevents the cleaning agent from being transferred to the photosensitive drum 10*c*. Also, the next transfer roller 25*m* is applied with a voltage of positive polarity, allowing the cleaning agent to be transferred to the next photosensitive drum 10*m*. See steps S203, S204, S105 in FIG. 2. Likewise, the cleaning agent is supplied to the photosensitive drums 10*y*, and then 10*k* (See steps S303, S304, S105, S403, S404, S405 in FIG. 2).

After the cleaning agent is supplied to all the photosensitive drums 10 (10*c*, 10*m*, 10*y*, 10*k*), the cleaning blade 31 of the transferring device 20 brings into contact with the outer surface of the belt 21 again (see step S106 in FIG. 2).

The cleaning agent born on the photosensitive drum 10 (10*c*, 10*m*, 10*y*, 10*k*) is transported by the rotation thereof to the portion where the cleaning device 14 confronts to the associated drum 10. Then, the cleaning agent is restricted by and retained on the edge of the blade 19, improving the collection of both toner and additive smaller than the toner. This prevents the generation of a film of additive on the photosensitive drum 10, which keeps an excellent charging property of the drum.

Figure 3:
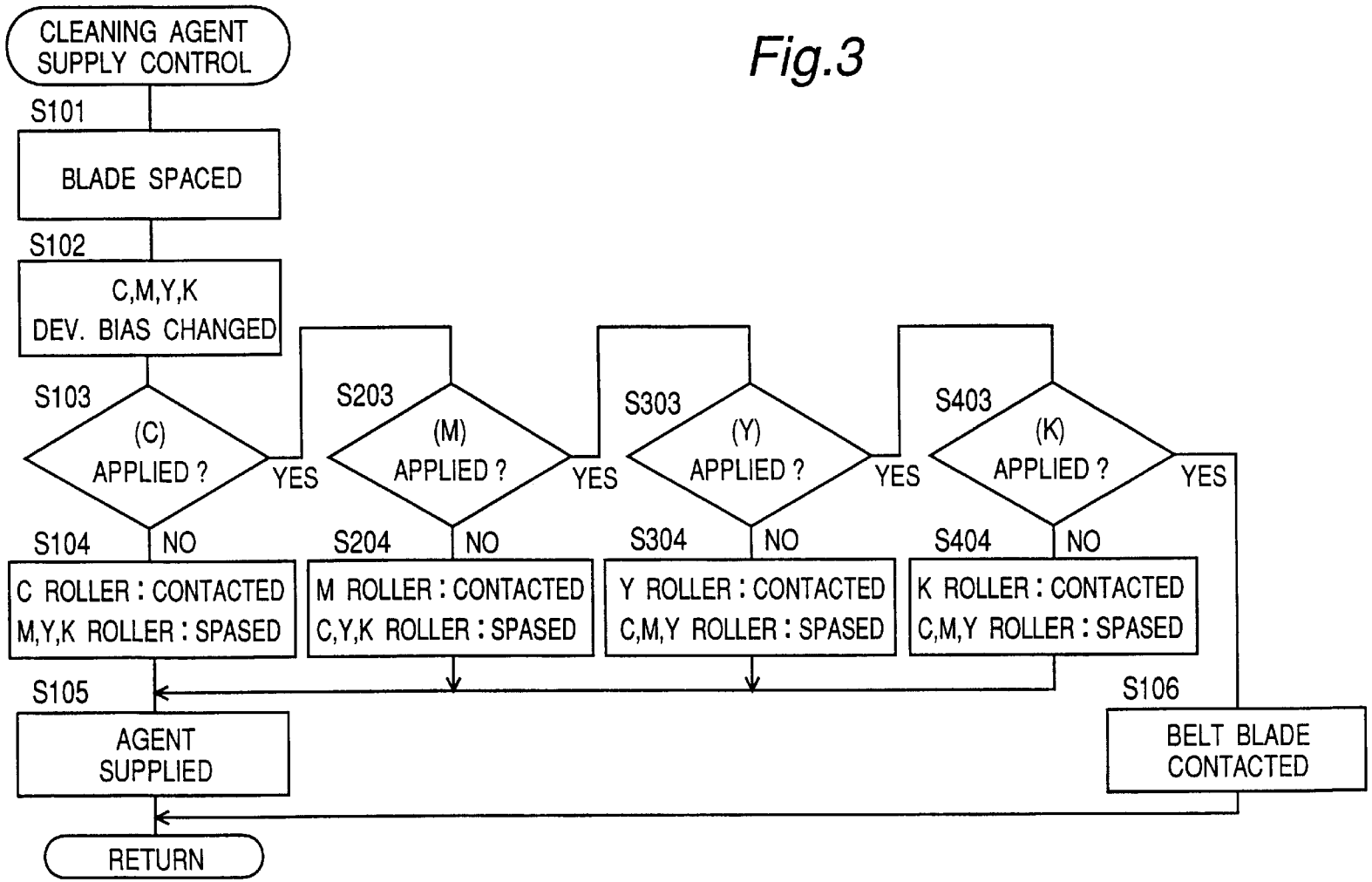
FIG. 3 is another program flow of the cleaning agent supply control performed in the image forming apparatus.

Although in the above described cleaning agent supplying process the cleaning agent is selectively supplied to the photosensitive drum by the change of voltages to be applied to the transfer rollers 25 (25*c*, 25*m*, 25*y*, 25*k*), this may be achieved in different manner. For example, each transfer roller 25 is designed so that it can be displaced between a first position where it is spaced away from the photosensitive drum and a second position where it is in contact with the drum by a drive member such as solenoid and motor, thereby forcing the belt 21 into contact with the associated photosensitive drum 10 to supply the cleaning agent to the drum 10 as required. A process program therefor is shown in FIG. 3. This program differs from that shown in FIG. 2 only in steps S104, S204, S304, S404. That is, when supplying the cleaning agent to a certain photosensitive drum, the associated transfer roller moves toward the certain photosensitive drum and thereby forces the belt to the drum while other transfer rollers remain away from the associated photosensitive drums.

Also, although the present invention has been described with the image forming device which comprises a plurality of photosensitive drums, it may be applied equally to another image forming device which includes only one photosensitive drum.

Further, although the present invention has been described with the belt type transferring device, it may be applied equally to another image forming device which includes other transferring device (e.g., roller type transferring device).

Furthermore, although the present invention has been described with the image forming device in which the sheet substrate is transported between the belt and the photosensitive drums where it is supplied with toner images, it may be applied equally to another image forming device in which the toner images are once transferred onto a transfer member (e.g., transfer belt or transfer drum) and then transferred again onto the sheet substrate therefrom.

(2) Second Embodiment

Figure 4:
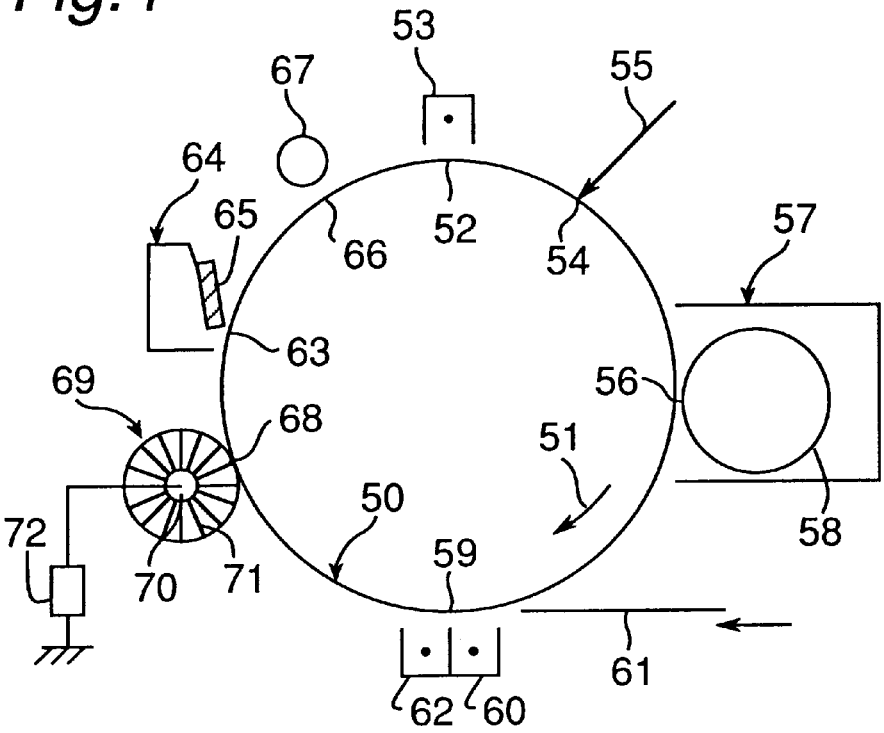
FIG. 4 is a cross sectional view of a main portion of the image forming apparatus according to the present invention.

Referring to FIG. 4, a second embodiment of the present invention will be described hereinafter. FIG. 4 shows a shows a main portion of an electrophotographic image forming device, such as, copy machine, printer and facsimile. The device includes a photosensitive member 50 as an electrostatic latent image bearing member. Although the photosensitive member 50 is in the form of cylindrical drum, it may have other configuration, such as endless belt. The photosensitive member 50 is supported for rotation in the direction indicated by the arrow 51 so that a portion of the photosensitive member 50 moves a series of image forming stations described below to visualize an image thereon according to the conventional electrophotographic image forming process.

In this electrophotographic image forming process, at a charging station 52, the outer peripheral portion of the photosensitive member 50 is electrically charged to a certain polarity by a charger 53. Assume that in this embodiment the outer pheripheral portion of the photosensitive member 50 is charged to a negative polarity. Although the charger 53 is illustrated as a corotoron charger, it may be other known charger, such as scrotoron charger, roller charger, brush charger and blade charger.

The outer peripheral portion of the photosensitive member 50 so charged is exposed at an exposing station 54 to a light 55 projected from an exposing device not shown so that an electrostatic latent image corresponding to the image to be reproduced is generated. The exposing device may be any one of conventional optical systems, such as scanning system typically used in an analogue copy machine, laser system typically used in a digital copy machine, and another optical system in which a number of light emitting elements are arranged parallel to an axis of the photosensitive member 10.

Next, the outer peripheral portion of the photosensitive member 50 which bears the electrostatic latent image so formed is advanced to a developing station 56 where the electrostatic latent image is developed by a developing device 57 into a visualized image. Any one of the conventional developing devices can be employed for the device 57. The developing device 57 includes a developer material which comprises a toner and an additive. The additive which will be described in detail below improves a developing, transferring and collecting properties of the toner.

The developing device 57 further includes a member for charging the toner and a component of the additive into a certain polarity. The charging member may be a carrier which would be mixed with the toner and the additive, thereby imparting them with the electric charge. Another charging member such as blade (not shown) may be used instead, which blade is mounted in contact with a roller 58 adjacent to the photosensitive member 50 so that it brings into contact with the developer material carried by the roller 58 and thereby provides the same with the electric charges. In this embodiment, the toner is charged to the same polarity (i.e., negative polarity) as the photosensitive member. On the other hand, some components of the additive are charged to the same polarity (i.e., negative polarity) and the remaining components thereof are to the opposite polarity (i.e., positive polarity). A ratio of the former components to the latter may be changed as required.

The visualized image of toner is then transported to a transfer station 59 where a transfer device 60 confronts to the photosensitive member 50. The transfer device 60 provides a sheet (e.g., paper or film) 61 with an electric charge having a certain polarity (i.e., positive polarity) opposite to that of the toner, which results in that the negatively charged toner is electrostatically attracted to the sheet and then transferred thereto. The sheet 32 moved past the transfer station 28 is detached by a detaching device 62 from the photosensitive member 10 and then transported to a fixing device not shown where the toner is fixed permanently to the sheet. Finally, the sheet is discharged onto a catch tray not shown.

Although the transfer device 60 is shown as a corotoron charger, it is not limited thereto and may be of other member (e.g., scrotoron or roller-type transfer device). Likewise, the detaching device 62 is shown as a crotoron charger, it is not restricted thereto and may be of other member (e.g., separating nail which makes in contact with the outer periphery of the photosensitive member).

Ideally, the toner deposited on the photosensitive member 50 would be entirely transferred onto the sheet 61. Practically, however, not all the toner is charged to the aimed polarity (negative polarity) and a part of which is unavoidably charged to the opposite polarity (positive polarity). The wrong sign toner moves past the transfer station 59 without being transferred onto the sheet 61 and then into a cleaning station 63.

At the cleaning station 63, a cleaning device 64 is mounted for collecting the residual wrong sign toner on the photosensitive member 50. In this embodiment, the cleaning device 64 has a blade 65 in the form of plate made of elastic material, one longitudinal edge of the blade 65 making a contact with the outer peripheral surface of the photosensitive member 50, thereby removing the residual toner therefrom.

Subsequently, the outer peripheral portion of the photosensitive member 50 is transported to an erasing station 66. At the erasing station 66, an erasing device 67 is mounted for erasing a residual charge on the peripheral portion of the photosensitive member 50 for the preparation of the next exposure. The erasing device 67 may be any one of conventional erasing members such as illuminating device and discharging device.

In addition to above described constructions, the image forming device of the embodiment according to the present invention includes a collecting station 68 between the transfer station 59 and the cleaning station 63. The collecting station 68 is used for collecting component or components electrically charged to the same polarity (negative polarity) as the toner, allowing only the component or components electrically charged to the opposite polarity (positive polarity) to move into the cleaning station 63.

For this purpose, mounted at the collecting station 68 is a brush roller 69 which has a rotatable shaft 70 arranged parallel to the photosensitive member 50 and a number of fibers or brushes 71 planted around the shaft 70. The shaft 70 and the brushes 71 are both made of electrically conductive material. Preferably, electrically conductive rayon fibers are used for the brushes. The brush roller 69 is arranged adjacent to the photosensitive member 50 so that distal ends of the brushes 71 contact with the outer peripheral surface of the photosensitive member 50. The shaft 70 is connected with a power supply 72 so that a collecting bias or voltage having a positive polarity opposite to that of the toner (e.g., +500 volts) can be applied through the shaft 70 to the brushes 71. This allows the brushes 71 to electrically attract the component or components of the additive having the polarity (i.e., positive polarity) opposite to that of the toner (i.e., negative polarity).

As described above, the additive born on the outer peripheral portion of the photosensitive member 50 that has moved past the transfer station 59 is brought into contact with the brushes 71 at the collecting station 68 where component or components of the additive charged to the same polarity (i.e., negative polarity) as the toner is electrically attracted and collected by the positively biased brushes 71. On the other hand, the remaining component or components of the additive charged to the opposite polarity (positive polarity) against the toner move past the collecting station 68 without being collected by the brushes 71 into the cleaning station 63 where they are restricted by the blade 65. This results in that the restricted component or components of the additive form a stationary mass thereof on the upstream side of a contact portion of between the blade 65 and the photosensitive member 50 with respect to the rotational direction of the photosensitive member 50, which stationary mass providing the cleaning device 64 with an improved collectability of the residual toner from the photosensitive member 50.

Thus, according to the embodiment of the present invention, not all the components of the additive supplied to the photosensitive member 50 are transported to the cleaning station 63 but only component or components of the additive, useful for collecting the residual toner, are selectively supplied to the cleaning station 63. As a result, a suitable (i.e., not excessive or insufficient) amount of additive remains at the cleaning station 63, which results in that the residual toner can be collected effectively. This further improves developing and fixing properties of the image forming device.

Typically, the additive is supplied at the developing of the electrostatic latent image to an image forming region of the photosensitive member 50 in which the electrostatic latent image is formed, though, it may be supplied to an intermediate region between the neighboring image forming regions. In this instance, preferably, a certain electrostatic latent image is formed in the intermediate region for electrically attracting the additive onto the photosensitive member 50.

Further, the additive may be supplied in a pre-treatment process which is performed immediately before the start of the image formation.

Furthermore, although the brush roller 69 is fixed so that the distal ends of the brushes make contacts with the photosensitive member, it may be supported to move between a first position in which the brushes contact with the photosensitive member 50 and a second position in which the brushes space away therefrom.

Figure 5:
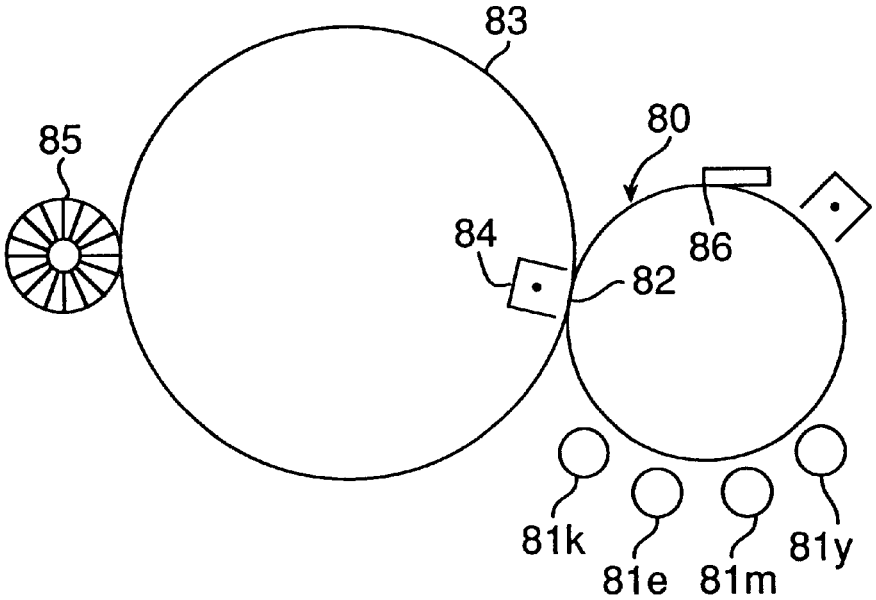
FIG. 5 is a cross sectional view of a main portion of a full color image forming apparatus according to the present invention.

Moreover, the principle of the embodiment according to the present invention will be applied to a full color image forming device as shown in FIG. 5. The full color image forming device includes a cylindrical photosensitive member 80 around which four developing devices 81*y*, 81*m*, 81*c* and 81*k* having yellow, magenta, cyan and black toners, respectively, are positioned. At a transfer station 82, a rotatable transfer drum 83 is mounted so that it can make a circumferential contact with the photosensitive member 80. Also, a transfer charger 84 is mounted within the transfer drum 82 so that it confronts to the photosensitive member 80 at the transfer station 82. Adjacent to an outer periphery of the transfer drum 83 is a brush roller 85 to which a voltage of certain polarity (positive polarity) opposite to the charged toner is applied. The brush roller 85 may be similar to the brush roller 69 in the previous embodiment.

In operation of the full color image forming device, toner images formed on the photosensitive member 80 by the developing devices 81*y*, 81*m*, 81*c*, 81*k* are transported one by one to the transfer station 82. At the transfer station 82, incremental portions moving past the transfer station 82 of the transfer drum 83 are provided with electric charge of certain polarity opposite to that of the toner by the transfer charger 84. This allows the toner images on the photosensitive member 80 to be transferred one by one and superimposed in a predetermined outer peripheral region of the transfer drum 83. The superimposed toner images are then transferred onto a sheet substrate not shown.

The toner images are not required to be superimposed on the transfer drum 83 and they may be transferred onto the transfer drum 83 one by one and then superimposed on the sheet substrate or they may be superimposed on the sheet substrate held on the outer peripheral surface of the transfer drum 83 by a suitable chuck mechanism.

In this embodiment, the additive is supplied from one or more developing devices. Then, component or components of the additive charged to the same polarity (negative polarity) as the toner are collected by the transfer drum 83 at charging by the transfer charger 84. This results in that component or components charged to different polarity (positive polarity) opposite to that of the toner are selectively transported to a cleaning station 86. The component or components of the additive transferred to the transfer drum 83 is then collected by the brush roller 85.

Discussions will be made to examples prepared by the inventors of the present invention.

EXAMPLE 1

In Example 1, a toner (black toner) was prepared using a mixture of 100 parts by weight of polyester resin (having etheleneglycoldenaturedbisphenol A as resin, propyleneglycoldenaturedbisphenol A as alcohol component and terephthalic acid as acid component), 5 parts by weight of carbon black as coloring matter, and 5 parts by weight of metalliferous salicylate compound as charge controller. The mixture was heated, kneaded, cooled and then pulverized into fine particles with several pulverizers. The particles were classified by the wind-classifier and then toner particles of having a mean diameter of 8 $\mu$m were obtained. The toner was post-treated by adding additive of 0.75 parts by weight of fine silica H1300, 0.75 parts by weight of fine titanic oxide particles STT30, and 1.5 parts by weight of strontium titanate oxide particles SW100 in order to improve the mobility and chargeability thereof and then mixed by Henshell Mixer. Carrier made of ferrite (having a mean diameter of 50 $\mu$m) available from PTK Co., coated with silicone acrylic resin, was used. A developer having a toner density of 6% was prepared by mixing the toner and the carrier. Resultant images were reproduced using the image forming device (Digital copy machine available from Minolta Co. under the tradename of Di30, copy speed of 30 copies per minute, using organic photosensitive drum) and the reproduced images were evaluated. In this copy machine, the toner was charged up to −25 micro coulomb force. A brush roller planted with conductive rayon fibers was used and applied with +500 volts when collecting the additive.

By the fact that the toner was negatively charged, it is to be understood that the carrier was positively charged. This can be demonstrated from a charging relationship of between the polyester resin which was a main component of the toner and silicone acrylic resin which was used as coating agent of the carrier. The fine silica particles have a tendency to be charged to the same polarity as the toner while the strontium titanate oxide particles have a tendency to be charged to the opposite polarity against the toner. That is, the fine silica particles and the strontium titanate oxide particles have tendencies to be negatively and positively charged, respectively, with respect to the toner.

Thus, as the brush roller was positively charged, the fine silica particles were electrostatically attracted to the brush roller and thereby removed from the photosensitive member. On the other hand, the strontium titanate oxide particles tend to be positively charged, they electrostatically repelled the brush roller and thereby remained on the photosensitive member. It should be noted that not all the silica particles and strontium titanate oxide particles are negatively and positively charged, respectively. Therefore, it can be presumed that only a small amount of silica particles can be retained on the photosensitive member while a small amount of strontium titanate oxide particles can be removed by the brush roller. The titanate oxide particle, on the other hand, does not have unneutral charging tendency as those of the silica particle and strontium titanate oxide particle and whether it would be negatively or positively charged depends upon an amount of titanate oxide contained therein, diameter thereof and a treatment method thereof. In spite of the charged polarity, as the brush roller is positively charged, titanate oxide particles negatively charges are electrostatically attracted to the brush roller and thereby removed from the photosensitive member and titanate oxide particles positively charged are electrostatically repelled from the brush roller and thereby retained on the photosensitive member.

In sum, it is advantageous that, at developing, the additive includes both negatively charged and positively charged particles. However, at cleaning of the photosensitive member, the additive including only particles charged to the opposite polarity to the toner is held in the vicinity of the contact region of between the cleaning member and the photosensitive member while the particles charged to the same polarity as the toner are removed therefrom is held in the vicinity of the contact region of between the cleaning member and the photosensitive member. For this reason, the particles charged to the same polarity as the toner is removed by the brush roller from the additive that has not been transferred by the transfer charger from the photosensitive member while the particles charged to the opposite polarity to the toner is retained on the photosensitive member and then provided to the contact region of the cleaning member and the photosensitive member.

EXAMPLE 2

In Example 2, images each extending in the axial direction and having a width of 1 cm (amount of toner to be deposited being 0.7 mg/cm$^2$) were formed in the intermediate region of the photosensitive member. The images were not transferred to the sheet substrate but removed from the photosensitive member at cleaning. Other conditions were the same as Example 1.

EXAMPLE 3

Three color-toners other than the black toner were used in the image forming device described in FIG. 5 to form images. Yellow toner was prepared by adding 3 parts by weight of pigment available from Dainippon Ink and Chemicals Inc. under the tradename of KET Yellow 401 using the manufacturing process described in Example 1. The same carrier as that used in Example 1 was used and mixed with the yellow toner to obtain the yellow developer. The yellow developer had an electric charge of −26 micro coulomb-force. Magenta toner was prepared by adding 3 parts by weight of pigment available from Dainippon Ink and Chemicals Inc. under the tradename of KET Red 103 and magenta developer was made in the same manner as the yellow developer. The magenta developer had an electric charge of −24 micro coulomb-force. Cyan toner was prepared by adding 3 parts by weight of pigment available from Dainippon Ink and Chemicals Inc. under the tradename of KET Blue 103 and cyan developer was made in the same manner as the yellow developer. The cyan developer had an electric charge of −27 micro coulomb-force.

An image forming device shown in FIG. 5 (Digital copy available from Minolta Co. under the tradename of CF900, copy speed of 6 copies per minute, using organic photosensitive drum) was used. Images each extending in the axial direction and having a width of 1 cm (amount of toner to be deposited being 0.7 mg/cm$^2$) were formed in the intermediate region of the photosensitive member and then transferred to the transfer drum by the transfer charger under the transfer bias of +700 volts.

COMPARATIVE EXAMPLE 1

Images were formed using an image forming device which differs from that used in the previous Example 1 in that the brush roller being eliminated therefrom.

Comparative Example 2

Images were formed using the image forming device in Example 1 without biasing the brushroller.

COMPARATIVE EXAMPLE 3

In this comparative Example, the toner was deposited on the intermediate portion of the photosensitive member. Then, the transfer drum was spaced apart from the photosensitive member so that the additives could not be transferred from the photosensitive member to the transfer drum.

COMPARATIVE EXAMPLE 4

Instead of the additive used in Example 1, another additive made of 0.75 parts by weight of fine silica particles H1300, 0.75 parts by weight of titanium oxide STT30, and 1.5 parts by weight of fine silica particles capable of being charged with the same polarity as the toner was added in the toner. The mixture was mixed by Henshell Mixer. Other conditions were the same as those of the Example 1.

Evaluation Items (a) Component Analysis

The full color copy machine, Minolta CF 900 and toners of Example 1 and comparative Example 4 were used. In the copy machine, the transfer drum was negatively biased. Components of the additive deposited on the transfer drum were analyzed using an electron microscope and the X-ray micro-analyzer.

(b) Noise on Image

A test image having a White/Black ratio of 6% was copied for 100,000 papers (A3/A5 size). In this copying, a process was repeated in which for the first 500 papers the image was copied and then for the second 500 papers the image was copied every three papers. A halftone image was copied and the existence of the noise was checked every 10,000 papers. In particular for the full color copy machine, a chart having 15% of yellow image, 15% of magenta image and 15% of cyan image was copied for 30,000 papers in the same mode as the monochrome image forming. The noise was checked every 5,000 papers.

(c) Analysis of Residual Toner

Toner restricted at the upstream side of the cleaning station on the photosensitive member was analyzed by the X-ray micro-analyzer to check and see whether the amount of additive having different polarity from the toner was more than that of toner.

(d) Qualitative and Quantitative Analysis

The additive remaining in the vicinity of the contact region of the blade and the photosensitive member was observed by the electron microscope and then analyzed by the X-ray micro-analyzer.

(e) Observation of Photosensitive Member

After copying, the surface of the photosensitive member was observed by the optical microscope and analyzed by the X-ray micro-analyzer. The quantitative analysis was made to fouling matters on the photosensitive member.

Evaluated Result

The evaluation result is as follows:

EXAMPLE 1

(a) Strontium titanate was detected on the transfer drum.

(b) Noises were observed if the number of copy was less than 100,000.

(c) Strontium titanate occupied a major part of the residual toner.

(d) Strontium titanate occupied a major part of the stationary mass. Large stationary masses of additive were detected.

(e) No fouling matter existed on the photosensitive member was clear.

EXAMPLE 2

(b) Noises were observed if the number of copy was less than 100,000.

(c) Strontium titanate occupied a major part of the residual toner.

(d) Strontium titanate occupied a major part of the stationary mass. Large stationary masses of additive were detected.

(e) No fouling matter existed on the photosensitive member was clear.

EXAMPLE 3

(b) Noises were observed if the number of copy was less than 30,000.

(c) Strontium titanate occupied a major part of the residual toner.

(d) Strontium titanate occupied a major part of the stationary mass. Large stationary masses of additive were detected.

(e) No fouling matter existed on the photosensitive member was clear.

COMPARATIVE EXAMPLE 1

(b) Noises were observed if the number of copy was more than 60,000.

(c) Silica and titanate occupied a major part of the residual toner.

(d) Silica and titanate occupied a major part of the stationary mass. Few stationary masses of additive were detected.

(e) Fouling matters of silica and titanate were detected.

COMPARATIVE EXAMPLE 2

(b) Noises were observed if the number of copy was more than 80,000.

(c) Silica and titanate occupied a major part of the residual toner.

(d) Silica and titanate occupied a major part of the stationary mass. Few stationary masses of additive were detected.

(e) Fouling matters of silica and titanate were detected.

COMPARATIVE EXAMPLE 3

(b) Noises were observed if the number of copy was more than 25,000.

(c) Silica and titanate occupied a major part of the residual toner.

(d) Silica and titanate occupied a major part of the stationary mass. Few stationary masses of additive were detected.

(e) Fouling matters of silica and titanate were detected.

COMPARATIVE EXAMPLE 4

(a) Nothing was detected on the transfer drum.

(b) Noises were observed if the number of copy was more than 50,000.

(c) Residual toner was formed exclusively by Silica and titanate.

(d) Only Silica and titanate were detected. Few stationary masses of small additives were detected.

(e) Fouling matters of silica and titanate were detected.

As is apparent form the result, the numbers of the copied papers on each of which the noise first appeared in Examples according to the present invention are less than those in Comparative Examples. This means that the present invention tends to prevent the forming of the noise. Also, in Examples according to the present invention, the stationary mass made of components charged in different polarity from the toner is stably formed on the upstream side of the blade and the photosensitive member, keeping the surface of the photosensitive member clean even after copying.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An image forming apparatus, comprising:

(a) a movable image bearing member;

(b) an image forming device for forming an image on the image bearing member with an electrically charged developer having an additive, the additive having one component configured for being charged to a same polarity as the developer and a second component configured for being charged to a different polarity from the developer;

(c) a transferring device for transferring the image from the image bearing member to a recording medium at a transfer station;

(d) a cleaning device having a cleaning member which makes a contact with the image bearing member for cleaning the image bearing member at a cleaning station located on a downstream side of the transfer station with respect to a direction along which the image bearing member travels; and (e) a processing device mounted between the transfer station and the cleaning station for processing the additive that has not been transferred but remains on the image bearing member so that the one component which is charged to the same polarity as the developer on the image bearing member is retained thereon and the other component which is charged to the different polarity from the developer is removed therefrom.

2. An image forming apparatus claimed in claim 1, further includes an electrode which is electrically charged with a polarity opposite to the developer.

3. An image forming apparatus claimed in claim 1, wherein the processing device includes a rotatable conductive brush which makes a circumferential contact with the image bearing member; and a power supply which applies the brush with a voltage having a different polarity from the developer.

4. An image forming apparatus claimed in claim 1, wherein the additive includes strontium titanate.

5. An image forming apparatus claimed in claim 1, wherein the additive includes silica and strontium titanate.

6. An image forming apparatus, comprising:

(a) a developing device for forming an image on an image bearing member using a developer with an additive, the developer being charged to one polarity and the additive being charged to the opposite polarity;

(b) a transferring device for transferring the image on the image bearing member to a recording medium at a transfer station;

(c) a cleaning device having a cleaning member which makes a contact with the image bearing member at a cleaning station located on a downstream side of the transfer station with respect to a direction along which the image bearing member travels; and (d) a removing device mounted between the transfer station and the cleaning station for charging the image bearing member with an electric charge of a certain polarity, whereby removing a part of the additive that is possibly charged with the certain polarity from the image bearing member.

7. An image forming apparatus claimed in claim 6, wherein the removing device includes a rotatable conductive brush which makes a contact with the image bearing member; and a power supply which applies the brush with a voltage having a different polarity from the developer.

8. An image forming apparatus claimed in claim 6, wherein the additive includes strontium titanate.

9. An image forming apparatus claimed in claim 6, wherein the additive includes silica and strontium titanate.

* * * * *